US005532100A

United States Patent [19]

Christy et al.

[11] Patent Number: 5,532,100

[45] Date of Patent: Jul. 2, 1996

[54] MULTI-ROLLER ELECTROSTATIC TONING

[75] Inventors: Orrin D. Christy, North Tonawanda; Daniel E. Kanfoush, Grand Island; Mark A. Matheis, North Tonawanda; John E. Pickett, Williamsville; Robert I. Thomson, Niton, all of N.Y.

[73] Assignee: Moore Business Forms, Inc., Grand Island, N.Y.

[21] Appl. No.: 639,360

[22] Filed: Jan. 9, 1991

[51] Int. Cl.[6] ..... G03G 9/08

[52] U.S. Cl. ..... 430/120; 430/109; 430/121; 355/250; 355/247; 355/261; 118/621; 118/650; 118/630

[58] Field of Search ..... 430/120, 109, 430/121; 355/250, 247, 261; 118/621, 650, 630, 637

[56] References Cited

U.S. PATENT DOCUMENTS

| | | | |
|---|---|---|---|
| 457,281 | 7/1973 | Maksymiak et al. . | |
| 2,998,802 | 9/1961 | Harris et al. | 118/637 |
| 3,008,826 | 11/1961 | Mott et al. | 96/1 |
| 3,059,614 | 10/1962 | Limberger | 118/637 |
| 3;133,833 | 5/1964 | Giaimo | 118/637 |
| 3,152,012 | 10/1964 | Schaffert | 118/637 |
| 3,380,437 | 4/1968 | Swyler | 118/637 |
| 3,393,663 | 7/1968 | Donalies | 118/637 |
| 3,703,157 | 11/1972 | Maksymiak et al. | 118/637 |
| 4,027,607 | 6/1977 | Pan et al. | 118/2 |
| 4,086,872 | 5/1978 | Pan | 118/630 |
| 4,141,645 | 2/1979 | Reid et al. | 355/3 DD |
| 4,777,106 | 10/1988 | Fotland et al. | 430/120 |
| 4,876,573 | 10/1989 | Kamimura | 430/120 |

FOREIGN PATENT DOCUMENTS

| | | |
|---|---|---|
| 37306/78 | 1/1980 | Australia . |
| 3213244 | 10/1983 | Germany . |
| 3213314 | 10/1983 | Germany . |
| 63-313330 | 12/1988 | Japan . |
| 1120900 | 7/1968 | United Kingdom . |

*Primary Examiner*—S. Rosasco
*Attorney, Agent, or Firm*—Nixon & Vanderhye

[57] ABSTRACT

Non-magnetic and non-conductive powdered toner is applied to a rotating image cylinder having an electrostatic pattern. A container having a closed bottom and sides and open top contains the powdered toner. The powder is fluidized by introducing air through a pervious closed bottom of the container, and by vibrating the container. The toner is simultaneously stirred and electrically charged to a potential of greater than about 7 kv (plus or minus polarity) by rotating elements with radial pointed appendages in the container. Toner is transferred from the container to an image cylinder at an exposed nine o'clock position of the image cylinder by a plurality of transfer cylinders. A first transfer cylinder is mounted so that its periphery is just above the open top of the container and an applicator cylinder has its axis below the axis of the first cylinder, and its periphery adjacent both the first cylinder and the image cylinder. A second cylinder is for the removal of opposite sign charged toner and low charge toner from the applicator cylinder. Scrapers scrape unused toner from the first and applicator cylinders so that it falls into the open top of the container.

28 Claims, 1 Drawing Sheet

MULTI-ROLLER ELECTROSTATIC TONING

BACKGROUND AND SUMMARY OF THE INVENTION

There are a number of advantages associated with non-magnetic and non-conductive toner, if it can be utilized instead of magnetic and conductive toner. Many present electrostatic imaging technologies, such as the present ion deposition printing (MIDAX) technology, presently use magnetic and conductive toner, and therefore are limited in color and print quality, and the toners are relatively expensive. Non-magnetic and non-conductive toners are available in a wide variety of colors, are available in a smaller particle size (which enhances print quality), and are generally less expensive than existing magnetic and conductive toners. Also, non-magnetic toner images placed on a printed page are advantageous in security printing applications, and will not interfere with magnetically scanned characters on the same area of a printed document.

There have been a number of proposals for utilizing lower conductivity and magnetic strength, or non-magnetic and non-conductive, toners, such as shown in U.S. Pat. No. 4,777,106. One method, which has been recognized to effectively utilize such toners, is to have the toner maintained in a fluidized condition and electrostatically charge the toner in the fluidized state. However, prior art techniques for maintaining the fluidized bed of powdered toner have not been entirely successful, and additionally prior art systems for transferring the fluidized toner to an image cylinder or the like have been restricted in scope. For example, some such proposals are truly useful only for application to an image cylinder at or about the six o'clock position and do not control wrong polarity or low charged toner. However, there is a need, in order to develop a practical system, to apply toner to an image cylinder at or above the nine o'clock position, provide high toner transfer efficiencies, and to control wrong polarity and low charge toner in order to maintain a clean background image.

According to the present invention a method and apparatus are provided which accomplish the above mentioned goals. The basic apparatus according to the invention for applying a non-magnetic and non-conductive toner to a member containing an electrostatic pattern (typically a rotating image cylinder) comprises the following elements: A container having a closed bottom and sides, for containing powdered toner. Means for fluidizing the toner in the container. Means for simultaneously stirring and electrically charging the powdered toner in the container; and means for transferring toner from the container to the member containing an electrostatic pattern. The simultaneous stirring and electrically charging means preferably comprises a plurality of rotating elements having radially outwardly extending sharp appendages (e.g. blades) mounted within the container, and charged to a high voltage, e.g. at least about 7 kv (e.g. +8 kv), causing a coronal or atmospheric breakdown of the fluidizing gases and depositing electrical charge on the surface of the toner particles in the bed. This means, although illustrated to work in the positive polarity mode (e.g. +8 kv) and imparting a positive polarity charge on the toner, is not restricted to the positive mode only. By reversing the polarity of the rotating elements, it has been found equal performance is achieved with a negative driving potential. (The means for transferring toner to the image cylinder—e.g. the rollers—are also run in opposite polarities to those described herein and performance is equal.) The means for running in either polarity described provides a means to control the toner to run in either polarity which makes the powder (toner) used material independent. That is to say, material and surface additives used to generate a specific triboelectric charging means is independent of this described electrostatic coronal charging process.

The fluidizing means preferably comprises a gas pervious false bottom of the container, with air being introduced between a solid bottom and the false bottom to flow upwardly into the container. Also, the fluidizing means preferably comprises an electrical vibrator mounted to one closed side wall of the container.

The powdered toner supply in the container is automatically replenished whenever it drops below a desired amount. This is accomplished utilizing an optical sensing means which senses the level of the toner, and controls a slotted roller mounted at the bottom of the hopper (which has downwardly sloping side walls) to discharge more toner into the open top of the container.

The means for transferring the toner from the container to the image cylinder preferably comprises a plurality of rotating conductive metallic cylinders mounted for rotation about generally horizontal, parallel axes, and means for electrically charging the cylinders. Preferably three cylinders are provided, a first cylinder having a peripheral surface thereof mounted just above the level of toner in the container at an open top portion thereof, a second cylinder having the axis thereof mounted above the axis of rotation of the cylinder and for removal of opposite sign charged toner and low charge toner from the last cylinder, and a last cylinder having the axis of rotation thereof mounted below the axis of rotation of the first cylinder, and having the peripheral surface thereof adjacent both the peripheral surface of the first cylinder, and the image cylinder. Scrapers are preferably associated with the first and last cylinders for scraping unused toner therefrom to fall back into the container through the open top thereof.

According to another aspect of the present invention, a method of applying non-conductive and non-magnetic toner to a member having an electrostatic pattern is provided, comprising the steps of: (a) supplying powdered non-conductive and non-magnetic toner to a container having a closed bottom, closed sides, and open top; (b) simultaneously stirring and electrically charging the powdered toner in the container; (c) maintaining the powdered toner in the container fluid; and (d) transferring charged toner from the container to a member having an electrostatic pattern thereon.

According to yet another aspect of the present invention, a method of applying non-conductive and non-magnetic toner to a member having an electrostatic pattern comprising an image cylinder rotating about a generally horizontal axis, having a peripheral portion thereof exposed at or above a nine o'clock position, comprises the following steps: (a) supplying powdered non-conductive and non-magnetic toner to a container having a closed bottom, closed sides, and open top; (b) electrically charging the powdered toner in the container; (c) maintaining the powdered toner in the container fluid; and (d) transferring charged toner from the container to the exposed, approximately nine o'clock positioned, peripheral portion of the image cylinder.

It is a primary object of the present invention to provide an effective method and apparatus for application of non-magnetic and non-conductive toner to a member containing an electrostatic pattern, such as an image cylinder. This and other objects of the invention will become clear from an inspection of the detailed description of the invention, and from the appended claims.

DETAILED DESCRIPTION OF THE DRAWING

Figure 1:
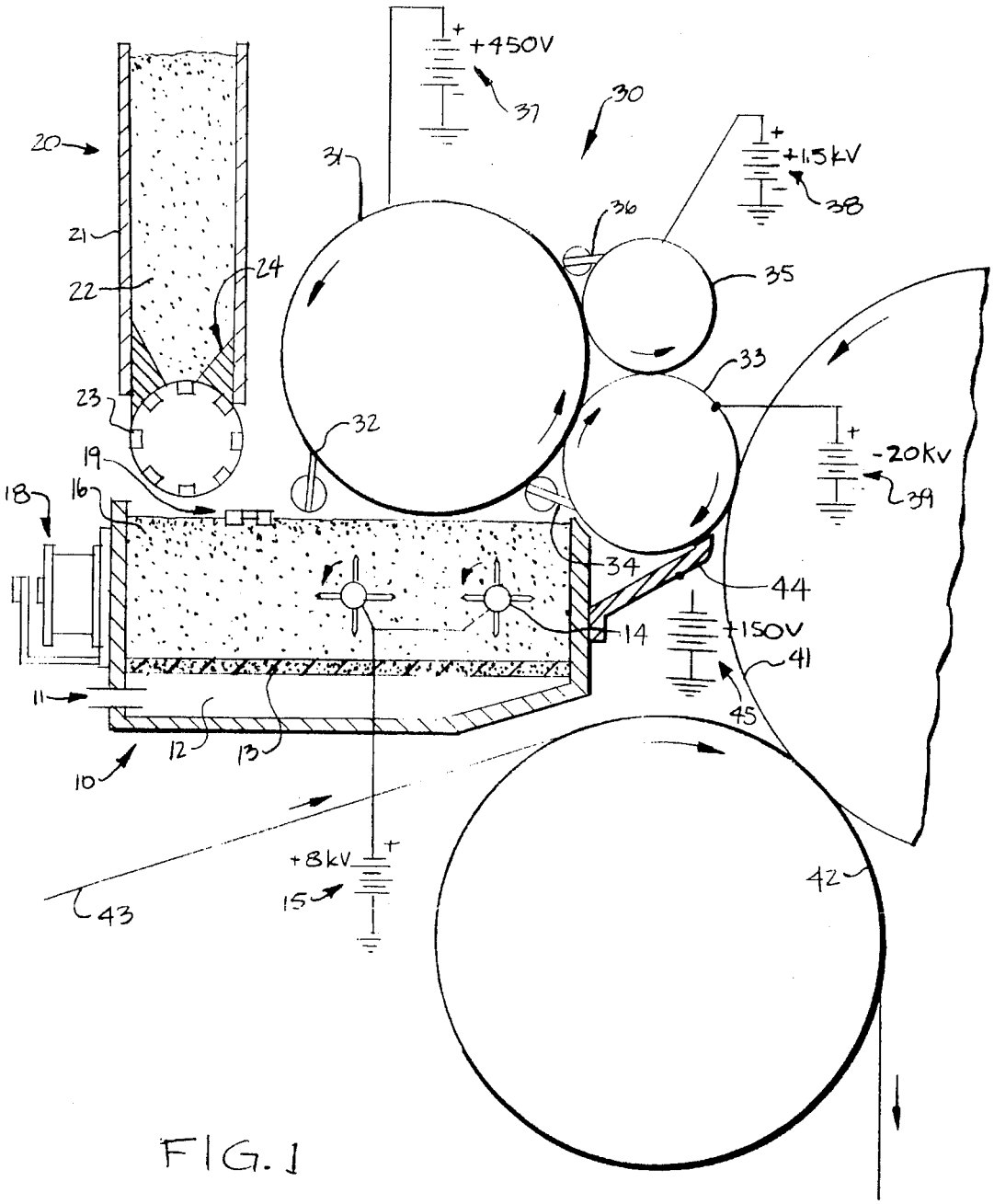
FIGURE 1 is a schematic side view, partly in cross section and partly in elevation, of exemplary apparatus according to the present invention.

FIGURE 1 illustrates an exemplary apparatus for applying non-magnetic and non-conductive toner to a member containing an electrostatic pattern. The major components of the system of FIGURE 1 comprise: the container 10 and its associated components, a hopper 20, a toner transfer means 30, and an image cylinder 41 and associated components.

The container 10 has a solid bottom and closed side walls, and an air pervious false bottom 13. Fluidizing gas, such as air, is introduced into the container through the opening 11 into the chamber 12 between the solid bottom and the false bottom 13 so that the gas flows upwardly through the air pervious false bottom 13 into the powdered non-conductive and non-magnetic toner 16 within the container. Also within the container are a plurality of rotating elements 14 having radially extending sharply pointed appendages (e.g. blades) which are connected up to a high voltage electrical source 15, e.g. an electrical source of greater than about 7 kv, in particular an +8 kv source in the exemplary embodiment illustrated. The elements 14 comprise means for simultaneously stirring and electrically charging the powdered toner 16 within the container.

It has been found that the rotary motion of the appendages 14 helps to uniformly stir and distribute the toner and furthermore they improve the uniformity of electrical charge and the rate of electrical charging within the bed. It was found by experimentation that the rotating coronal points are far superior on these presented points when compared to a single stationary coronal wire or an array of stationary coronal points.

The mechanism of charging is related to the coronal action or gas breakdown and ionization due to the electrical field at the coronal points. This driving mechanism deposits a charge on the surface of the toner articles. Through experiment, it has been determined that the potential voltage resident on the surface of the fluidized bed matches that of applied potential of the driving elements 14. The polarity of the charge on the toner also matches that of the polarity of the potential applied to the driving elements.

Independence of toner polarity is a significant advantage. Most toners are material sensitive, that is, to achieve a specific polarity electric charge, material composition and surface charging agents are added so that specific polarity needed is achieved when the toner triboelectrically charges itself during frictional encounters with other toners, stirring elements, developer material, etc. Through experiment, it has been found that within the fluidized electrostatic bed that toner polarity is material independent—that the means for charging places the needed polarity charge on the toner particles. Operation of the remainder of the system components would simply revert to running in an opposite sign (e.g.—the rollers and electrostatic image on the imaging cylinder).

The air pervious false bottom 13 may be made of any suitable pervious material, for example, a five micron passage Porex polyethylene porous material, or a submicron diffuser made of at least a single layer of porous stainless steel.

Fluidization of the powder 16 is also accomplished by vibrating means. The vibrating means preferably comprises a conventional electric vibrator 18 which is mounted on one of the closed side walls of the container 10, e.g. just above the air introduction passage 11 for fluidizing gas.

It is desirable to automatically replenish the supply of toner powder 16 within the container 10 once it drops below a desired level. It is important that there be proper transfer of toner from the container 10 to the transfer system 30, and therefore the level of toner must be relatively carefully maintained. Preferably a sensing means—such as an optical sensor—is provided to facilitate this level maintenance function.

The hopper 20, having straight side walls 21 with powdered non-conductive and non-magnetic toner 22 contained therein, cooperates with the optical sensor 19 to resupply the container 10 with toner. This is preferably accomplished by utilizing a slotted roller 23 rotatable about a generally horizontal axis, and mounted at the bottom of the side walls 21, preferably below the sloping side wall portions 24 which facilitate feeding of the powdered toner from the hopper 21 to the slots in the roller 23. The slotted roller 23 supplies a measured amount of toner into the container 10 for each rotation, or each partial rotation.

The transfer means 30 preferably comprises a first metallic conductive cylinder 31 having a scraper 32 associated therewith, a metallic conductive applicator cylinder 33 having a scraper 34 associated therewith, and a second metallic conductive cylinder 35 having a scraper 36 associated therewith. The sources of electrical potential 37, 38, and 39 charge the cylinders 31, 35, and 33, respectively. All of the cylinders 31, 33, 35 are mounted for rotation about generally horizontal axes, the axis of the cylinder 35 preferably being slightly above the axis of the cylinder 31, and almost directly above the axis of the cylinder 33, while the axis of the cylinder 33 is preferably below the axis of the cylinder 31. The cylinder 31 is mounted so that its peripheral surface is just barely above the level of toner 16 within the container 10, and the cylinder 33 is mounted so that its periphery is adjacent both the periphery of the cylinder 31 and the dielectric coated image cylinder 41.

The roller systems 30 enable toner to be applied to a dielectric coated image cylinder 41 at about a nine o'clock position of the image cylinder 41—near the three o'clock position of the cylinder 33. Note that the cylinder 33 rotates in a direction of rotation opposite that of both the cylinders 31 and 41. Cylinders 31, 33 and 35 are all driven at speed such that the surface velocities are all matched and either noted or are slightly overdriven above that of the image cylinder 41. The cylinder system 30 also has excellent control over wrong polarity and the low charge toners and excellent level control is possible because of the gap transfers between the cylinders.

During operation, the electrical potential developed on the top of the fluidized bed surface of toner 16 sets up an electrical field with the toner first (feed) 31. The first cylinder 31 is biased to about +450 volts by the power supply 37. Even though the toner at the surface of the bed is positively charged, a mass of violent migration of the positive toner occurs to coat cylinder 31 as it rotates in front of the bed surface. The field established between the bed and the cylinder 31 is about 2.5 million ($2.5\times10^6$) volts per meter, so that migration of the charged toner is extremely fast. Residual toner on the cylinder 31 is continuously scraped back into the bed through the open top thereof by the scraper 32. It has been found that toner layer uniformity is best achieved by presenting a clean cylinder surface to the field present above the electrostatic fluidized bed, hence all residual toner is totally removed by scraper 32.

At the gap between the first cylinder 31 and the last, applicator, cylinder 33, toner is transferred by the electrical field set up by the potentials 37 and 39 (the preferred potential 39 being about −20 volts). Means are also provided for adjustment of this potential to create necessary electrical fields between the applicator 33 and the electrostatic images on the image cylinder 41 to achieve the necessary threshold levels to produce good quality high contrast images (image to background ratios).

The transfer of toner between transfer cylinder 31 and applicator roller 33 and also between applicator roller 33 and image cylinder 41 may be enhanced also by providing a low frequency (1000 hz) A.C. bias in addition to the existing D.C. potential 39 to help overcome the electrostatic adhesion force of the toner to the roller. The field between the cylinders 31, 33 is about $2\times10^6$ volts per meter, and toner "jumps" to cylinder 33 with a transfer efficiency of greater than about 85%.

At the gap between the applicator cylinder 33 and the image cylinder 41, toner is transferred to image areas (the image cylinder 41 has an electrostatic pattern thereon) which have approximately a −300 volt surface potential. Once again, the field between the cylinders 33, 41 is about 2.0EO6 volts per meter. Untransferred and residual toner is returned to the container 10 through the open top by the scraper blade 34. Applicator cylinder 33 may also be a resilient coated member with a conductive coating on the periphery, and still biased by potential source 39. Such a cylinder would then be held in light contact with image cylinder 41 and transfer of the charged toner would still be effected by the field between applicator cylinder 33 and the electrostatic image on imaging cylinder 41. The cylinders 31, 33 are entirely cleaned on each rotation. Transfer and toner density can be controlled by varying the electrical fields found between the cylinders by controlling the potential on the fluidized bed through high voltage electrical source 15, or by controlling the potential, on roller 31, by adjusting potential 37, or on roller 33 by adjusting potential 39.

To control toner dust vectoring and prevent clumped toner from dropping to the paper **23*b* 43, a metallic conductive shield 44, which is biased to about +150 V by potential 45**, is mounted to the front of the container.

The control cylinder 35 has the function of removing opposite polarity toner and low charge to mass ratio toner from the cylinder 33. At the gap between the cylinders 35, 33 a very high field (4.5EO6 volts per meter) is set up by the potential source 38 of about +1500 volts. This attracts any existing negatively charged toner particles and also induces a negative charge on any low charge particles on the cylinder 33. These toner particles are removed from the control cylinder 35 by the scraper blade 36, and/or are vacuumed off (vacuum not shown).

It will thus be seen that the apparatus illustrated in FIGURE 1 can be used for a method of applying non-conductive and non-magnetic toner to an image cylinder 41. The steps are supplying powdered non-conductive and non-magnetic toner 16 to the container 10; simultaneously stirring and electrically charging the powdered toner in the container 10 with the bladed, charged rotating elements 14; maintaining the powdered toner in the container 10 in fluid condition by introducing gas through the porous false bottom 13, and vibrating the container 10 utilizing the vibrator 18; and transferring charged toner from the container 10 to the image cylinder 41 utilizing the transfer system 30. Toner particles jump from the container 10 to the periphery of the cylinder 31, then jump from the cylinder 31 to the applicator cylinder 33, and ultimately from the cylinder 33 to the image cylinder 41. From the image cylinder 41, the toner is applied onto the paper web 43 on the transfer cylinder 42 at the nip point between the cylinders 41, 42. The method also is practiced to apply the toner to the portion of the image cylinder 41 that is approximately at the nine o'clock position, the cylinder 33 applying the toner at approximately the three o'clock position thereof.

It will thus be seen that according to the present invention an advantageous method and apparatus have been provided for applying non-magnetic and non-conductive toner to a member containing non-electrostatic pattern. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent apparatus and methods.

What is claimed is:

1. Apparatus for applying non-magnetic and non-conductive toner to a member containing an electrostatic pattern, comprising:

(a) a container having a closed bottom and sides, for containing powdered toner;

(b) means for fluidizing the toner in the container;

(c) means for simultaneously stirring and electrically charging the powdered toner in the container; and (d) means for transferring toner from the container to a member containing an electrostatic pattern.

2. Apparatus as recited in claim 1 wherein said container closed bottom is gas pervious, and wherein said means (b) comprises means for directing gas into the powdered toner within the container through said gas pervious bottom.

3. Apparatus as recited in claim 2 further comprising means for replenishing the toner supply in said container when it drops below a desired amount, comprising: an open top of said container; a hopper located above said open top; and sensing means for sensing the level of toner in said container, and controlling said hopper to release powdered toner into said container when the level is below the desired amount.

4. Apparatus as recited in claim 2 wherein said means (b) further comprises means for vibrating said container.

5. Apparatus as recited in claim 4 wherein said vibrating means comprises an electrical vibrator attached to one closed side wall of said container, above the introduction of gas to effect fluidization.

6. Apparatus as recited in claim 2 wherein said gas pervious bottom of said container comprises a false bottom, a solid bottom being provided below said gas pervious bottom, and gas being introduced between said bottoms; and wherein said air pervious bottom is selected from the group consisting essentially of porous polyethylene and porous stainless steel.

7. Apparatus as recited in claim 1 further comprising means for replenishing the toner supply in said container when it drops below a desired amount, comprising: an open top of said container; a hopper located above said open top; and sensing means for sensing the level of toner in said container, and controlling said hopper to release powdered toner into said container when the level is below the desired amount.

8. Apparatus as recited in claim 7 wherein said hopper includes a slotted feed roller rotatable about a generally horizontal axis located at an open bottom thereof, said sensing and controlling means controlling rotation of said roller in response to a low level condition.

9. Apparatus as recited in claim 8 wherein said sensor comprises an optical sensor.

10. Apparatus as recited in claim 8 wherein said hopper further comprises sloping wall portions sloping from an upper portion of said hopper toward said slotted roller to facilitate feeding of powdered toner from said hopper to the slots in said roller.

11. Apparatus as recited in claim 1 wherein said means (d) comprises a plurality of conductive metallic rotating cylinders mounted for rotation about generally horizontal, parallel, axes, having the peripheral surfaces thereof spaced from said container; and means for electrically charging said cylinders.

12. Apparatus as recited in claim 11 wherein said plurality of cylinders comprises an applicator cylinder for transferring toner therefrom to the member with an electrostatic pattern, said applicator cylinder actually transferring toner at approximately a three o'clock position.

13. Apparatus as recited in claim 12 wherein said plurality of cylinders comprises three cylinders, a first cylinder having the peripheral surface thereof mounted just above the level of toner in said container at an open top portion of said container; a second cylinder having the axis thereof mounted above the axis of rotation of said first cylinder and for removal of opposite sign charged toner and low charge toner from said applicator roller; and said application cylinder having the axis of rotation thereof mounted below the axis of rotation of said first cylinder, and having the peripheral surface thereof adjacent both the peripheral surface of said first roller, and said member with an electrostatic pattern.

14. Apparatus as recited in claim 13 further comprising scraper means associated with said first and application cylinders for scraping unused toner therefrom to fall back into said container through the open top thereof.

15. Apparatus as recited in claim 1 wherein said means (c) comprises a plurality of rotating elements having radially outwardly extending pointed appendages.

16. Apparatus for applying powdered non-magnetic and non-conductive toner to a member containing an electrostatic pattern, comprising:

(a) a container having a closed bottom and sides, for containing powdered non-magnetic and non-conductive powdered toner;

(b) means for electrically charging the powdered toner in the container; and (c) means for transferring powdered toner from the container to a member containing an electrostatic pattern, said means comprising: a plurality of conductive metallic rotating cylinders mounted for rotation about generally horizontal, parallel, axes, having the peripheral surfaces thereof spaced from said container; and means for electrically charging said cylinders.

17. Apparatus as recited in claim 16 wherein said plurality of cylinders comprises an applicator cylinder for transferring toner therefrom to said member with an electrostatic pattern, said applicator cylinder actually transferring toner at approximately a three o'clock position.

18. Apparatus as recited in claim 17 wherein said plurality of cylinders comprises three cylinders, a first cylinder having the peripheral surface thereof mounted just above the level of toner in said container at an open top portion of said container; a second cylinder having the axis thereof mounted above the axis of rotation of said first cylinder and for removal of opposite sign charge toner and low charge to mass ratio toner from said applicator roller; and said applicator cylinder having the axis of rotation thereof mounted below the axis of rotation of said first cylinder, and having the peripheral surface of said first roller, and said member with an electrostatic pattern.

19. Apparatus as recited in claim 18 further comprising scraper means associated with said first and applicator cylinders for scraping unused toner therefrom to fall back into said container through the open top thereof.

20. Apparatus as recited in claim 17 wherein said member with an electrostatic pattern comprises a rotating image cylinder, rotating in the opposite direction of rotation from said applicator cylinder.

21. Apparatus for applying powdered toner to a member containing an electrostatic pattern, comprising:

(a) a container having a closed bottom and sides, for containing powdered toner;

(b) means for fluidizing the toner in the container;

(c) means for electrically charging the powdered toner in the container;

(d) means for transferring toner from the container to a member containing an electrostatic pattern; and (e) means for replenishing the toner supply in said container when it drops below a desired amount, comprising: an open top of said container; a hopper located above said open top; and sensing means for sensing the level of toner in said container, and controlling said hopper to release powdered toner into said container when the level is below the desired amount.

22. Apparatus as recited in claim 21 wherein said hopper includes a slotted feed cylinder rotatable about a generally horizontal axis located at an open bottom thereof, said sensing and controlling means controlling rotation of said cylinder in response to a low level condition.

23. Apparatus as recited in claim 22 wherein said sensor comprises an optical sensor.

24. Apparatus as recited in claim 23 wherein said hopper further comprises sloping wall portions sloping from an upper portion of said hopper toward said slotted roller to facilitate feeding of powdered toner from said hopper to the slots in said roller.

25. Apparatus for applying powdered toner to a member containing an electrostatic pattern, comprising:

(a) a container for containing powdered toner having a closed bottom and sides, said closed bottom comprising an air pervious false bottom which engages toner, and a solid bottom disposed below said false bottom;

(b) means for fluidizing the toner in the container, comprising means for directing gas into the powdered toner within the container between the solid and false bottoms, then through said gas pervious bottom;

(c) means for electrically charging the powdered toner in the container; and (d) means for transferring toner from the container to a member containing an electrostatic pattern.

26. Apparatus as recited in claim 25 wherein said means (b) further comprises means for vibrating said container.

27. Apparatus as recited in claim 26 wherein said vibrating means comprises an electrical vibrator attached to one closed side wall of said container, above the introduction of gas to effect fluidization.

28. Apparatus as recited in claim 25 wherein said air pervious false bottom is of material selected from the group consisting essentially of porous polyethylene and porous stainless steel.

* * * * *